US005384929A

United States Patent [19]

Smith

[11] Patent Number: 5,384,929

[45] Date of Patent: Jan. 31, 1995

[54] PIG FOR USE IN CLEANING THE INTERIOR WALL OF A PIPELINE

[75] Inventor: Dennis R. Smith, Tulsa, Okla.

[73] Assignee: TDW Delaware, Inc., Wilmington, Del.

[21] Appl. No.: 227,671

[22] Filed: Apr. 14, 1994

[51] Int. Cl.[6] ..... B08B 9/04

[52] U.S. Cl. ..... 15/104.061

[58] Field of Search ..... 15/104.061, 104.063, 15/3.5, 3.51

[56] References Cited

U.S. PATENT DOCUMENTS

| | | | |
|---|---|---|---|
| 3,204,274 | 9/1965 | Knapp | 15/104.061 |
| 3,389,417 | 6/1968 | Knapp et al. | 15/104.061 |
| 3,474,479 | 10/1969 | Girard | 15/104.061 |
| 3,605,159 | 9/1971 | Girard | 15/104.061 |
| 3,879,790 | 4/1975 | Girard | 15/104.061 |
| 4,122,575 | 10/1978 | Sagawa | 15/104.061 |
| 4,406,030 | 9/1983 | Platts | 15/104.061 |
| 4,406,031 | 9/1983 | Elmer et al. | 15/104.061 |
| 4,720,884 | 1/1988 | Ralls | 15/104.061 |
| 4,825,498 | 5/1989 | Rankin | 15/104.061 |
| 4,907,314 | 3/1990 | Kershaw | 15/104.061 |

*Primary Examiner*—Edward L. Roberts
*Attorney, Agent, or Firm*—Head & Johnson

[57] ABSTRACT

A cleaning pig for use in a pipeline to be moved through the pipeline by the flow of fluid therethrough, the pig being formed of a cylindrical body of foam plastic material, the body having a cylindrical surface and the cylindrical surface having shallow depth channels formed in parallelled spiraled patterns. An elongated cleaning member is positioned in each of the channels. Each of the cleaning members has an integral substratum of a width less than the width of a channel and each of the cleaning members has integral upstanding spaced apart studs projecting from the substratum upper surface, the studs each having a top surface that extends above the pig body external cylindrical surface, the substratum lower surface being bonded to the cylindrical body. The upstanding studs each has a top surface to non-abrasively contact and clean the interior surface of a pipeline.

6 Claims, 2 Drawing Sheets

PIG FOR USE IN CLEANING THE INTERIOR WALL OF A PIPELINE

BACKGROUND OF THE INVENTION

This disclosure relates to a pig for use to clean the interior wall of a pipeline. The interior surfaces of pipelines employed for moving fluids, whether liquids or gases, tend to become encrusted caused either by oxidation, or other chemical reaction, if the pipeline is made of metal, or deposits of solids from the fluid passing through a pipeline. Solids can be deposited on the interior of the pipeline whether it is made of metal or plastic. As solids adhere to the interior wall of the pipeline, or encrustation build up, the maximum fluid carrying potential of the pipeline is decreased. It has long been a practice of pipeline operators to periodically clean the interior of the pipelines by passing cleaning pigs through them.

A cleaning pig is a device that fits in the interior of a pipeline and is moved by fluid flow through the pipeline. Some means is provided on the pig to engage the interior wall of the pipeline to scrape or brush the interior to dislodge solid materials. For information relating to the use of pipeline pigs that have means for brushing or scraping the interior wall of a pipeline as it passes therethrough, reference may be had to the following U.S. Pat. Nos. 3,204,274; 3,879,790; 3,538,531; 3,605,159; 3,389,417; 3,474,479; 4,122,575; and 4,720,884.

One type of cleaning pig that has been successful is referred to in the trade as a "foam pig". Foam pigs are given this name since they are characteristically made out of plastic foam, such as polyurethane foam. This product has desirable characteristics when used to form a pipeline pig. It is semi-rigid, that is, it has strength and toughness and yet can be deformed. A foam pig can be made to have an external diameter slightly greater than the internal diameter of the pipeline in which the pig is to be used so that the pig is slightly compressed when it is inserted into the pipeline so as to securely urge the external surface of the pig against the pipeline interior wall.

Another reason for using polyurethane foam for making pigs is that it is durable and relatively inexpensive compared to making pigs having metal bodies or bodies made of rigid, non-flexible plastic.

To make a "foam pig", that is, a pig having a body made of polyurethane, function as a cleaning pig, it is usually desirable to increase the abrasiveness of the surface of the pig. One way of doing this is to attach a brushing element. This can be done by forming spiral grooves in the exterior surface of the foam pig and securing in the spiral grooves an elongated wire brush strip having bristles that normally extend above the pig body cylindrical surface. For information relating to the use of a foam pig body for cleaning operations wherein a brush means is included on the body cylindrical surface, reference may be had to U.S. Pat. No. 4,720,884 entitled "Cleaning Pig With Debris Flushing Action" issued Jan. 26, 1988 and U.S. Pat. No. 4,825,498 entitled "Cleaning Pig With Selectable Debris Flushing Action" issued May 2, 1989. Each of these patents are incorporated herein by reference.

The two United States patents above-referenced provide cleaning pigs that have produced good results in industrial application. One slight problem encountered with pigs that have wire brushes as a part of the cleaning action is that the wire brushes can, in some applications, scratch the interior surface of the pipeline in which they are used. This is particularly true when the pipeline is made of plastic, or if the pipeline has some other kind of lining that can be marred by metal bristles.

The present invention provides an improved pig for use in cleaning the interior wall of a pipeline. The invention employs an elongated cylindrical pig body made of foam plastic material and includes on the pig body exterior surface, elongated cleaning members positioned in channels. Each cleaning member is made in the form of a strip having a plastic substratum of a width less than the width of channel in which it is positioned. The cleaning member has integral upstanding studs projecting from the substratum, the top surface of the studs forming contact surfaces that engage the interior of a pipe through which the cleaning pig is moved to clean the surface of the pipe without marring or otherwise damaging the surface.

BRIEF SUMMARY OF THE INVENTION

This invention provides a pig for use in cleaning the interior wall of a pipeline. The pig is formed of an elongated cylindrical body made of plastic foam, such as polyurethane foam. The body has an external diameter substantially equal to or in some cases slightly larger than the internal diameter of the pipeline for which the pig is dimensioned.

A plurality (such as three, four or more) spaced apart shallow depth channels are formed on the pig body cylindrical surface. Each of these channels is in the form of a spiral and each channel extends adjacent the rear end of the pig body to adjacent the forward end. The channels are configured so that the entire cylindrical surface of a pipe internal wall is passed over by a channel. For example, if there are N channels in spaced apart spiral format, each channel covers a segment of the cylindrical body external surface through an arc of more than 360°/N.

Positioned in each of the channels is an elongated cleaning member. Each of the cleaning members is in the form of a plastic substratum of a width less than the width of the channel. The plastic substratum has an upper and lower surface. Formed integrally with the upper surface are spaced apart upstanding studs. Each of the studs has a top surface that extends above the pig body external cylindrical surface. The substratum lower surface is bonded to the cylindrical body.

The upstanding studs, each having a top surface, non-abrasively contact and clean the interior surface of the pipeline.

The cleaning member having the integral upstanding studs is preferably made of urethane or some other type of tough, durable plastic.

The cross-sectional configuration of the upstanding studs can vary. A configuration that functions successfully is one in which the upstanding studs are cylindrical so that the top surface is round.

The integral upstanding studs are preferably arranged in rows that are in planes perpendicular to the length of the elongated cleaning member and in columns that are in planes parallel to the plane of the length of the elongated cleaning member so as to allow the studs to be spaced equally apart to provide a uniform pattern of studs that contact the pipe wall.

A better understanding of the invention will be obtained from the following description of the preferred embodiments, taken in conjunction with the attached drawings.

DESCRIPTION OF THE PREFERRED EMBODIMENTS

Figure 1:
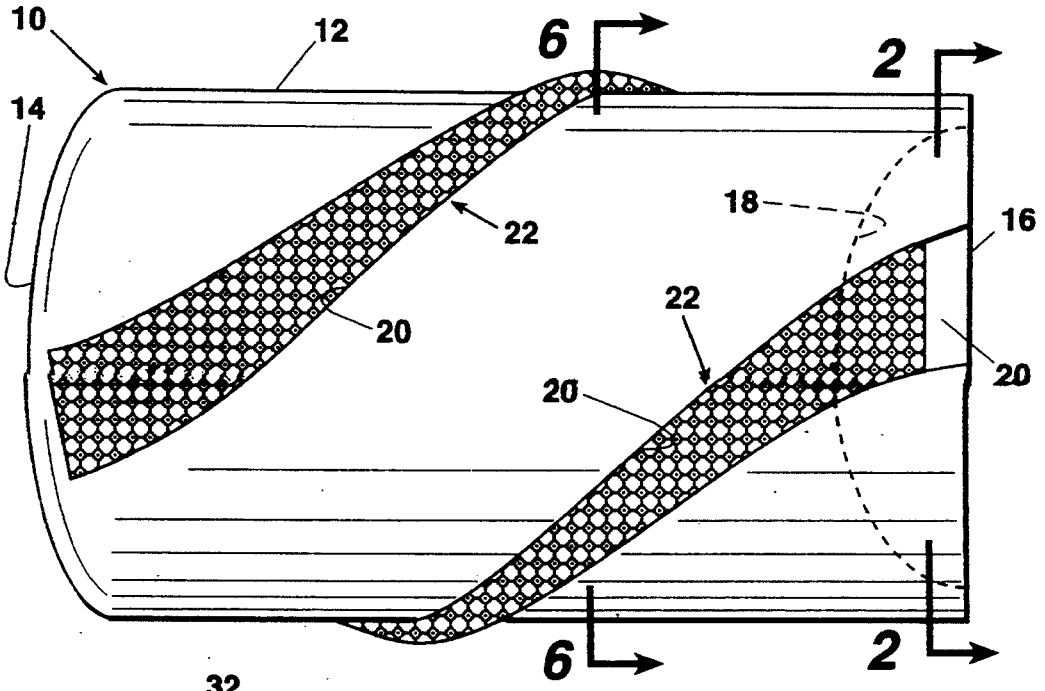
FIG. 1 is an elevational view of a cleaning pig of the type that has a cylindrical body, preferably made of urethane foam, and having elongated cleaning strips positioned in grooves in the exterior surface of the body.

Referring to the drawings and first to FIG. 1, an elevational view of a cleaning pig is shown that illustrates the principles of the invention. The cleaning pig is generally indicated by the numeral 10 and has an external cylindrical surface 12, a front or nose end 14 and a rearward end 16. The front end 14 is typically slightly rounded since the pig is configured to move in the forward direction as it is passed through a pipeline. Rearward end 16 may be flat or preferably concaved, that is, provided with a concaved rearward surface 18.

The pig body 10 is preferably formed of an elastomeric material. A material that functions well for this application is urethane since it has the characteristics of being resilient but, at the same time, it is tough and wear resistant.

Figure 2:
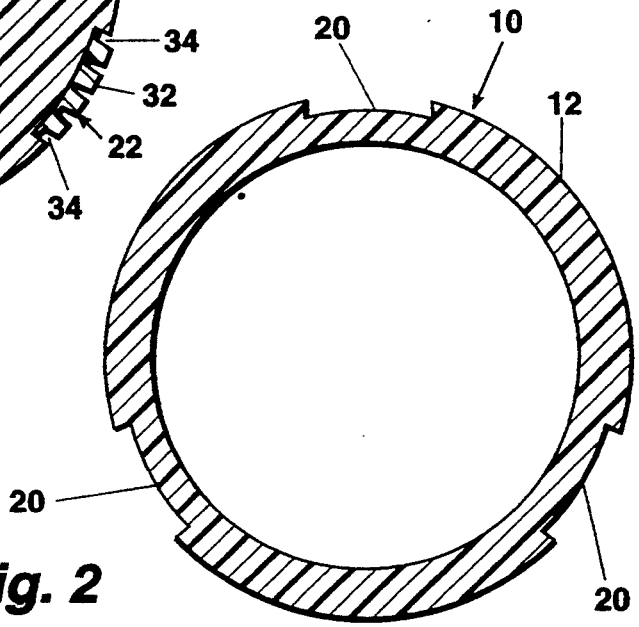
FIG. 2 is a cross-sectional view of the pig of FIG. 1 as taken along the line 2—2 of FIG. 1 showing the end portion of the pig body and showing the grooves formed therein.

Formed in the body external cylindrical surface 12 are a plurality (3 in the embodiment illustrated) of spaced apart channels 20, as best seen in FIG. 2. Channels 20 are relatively shallow and have bottom surfaces that are concentric about the longitudinal axis of the pig and preferably have radially extending sidewalls, although the sidewalls could flare outwardly slightly if desired. Channels 20 are each formed in a spiral pattern in the pig body external cylindrical surface 12. The spiral pattern of the channels is such that in any plane taken along the longitudinal axis of the cylindrical body 10, the plane would pass through at least one channel. Another way of stating it is, that if there are N number of channels in spaced apart spiral format, each channel covers a segment of the cylindrical body external surface through an arc of more than 360°/N.

Figure 3:
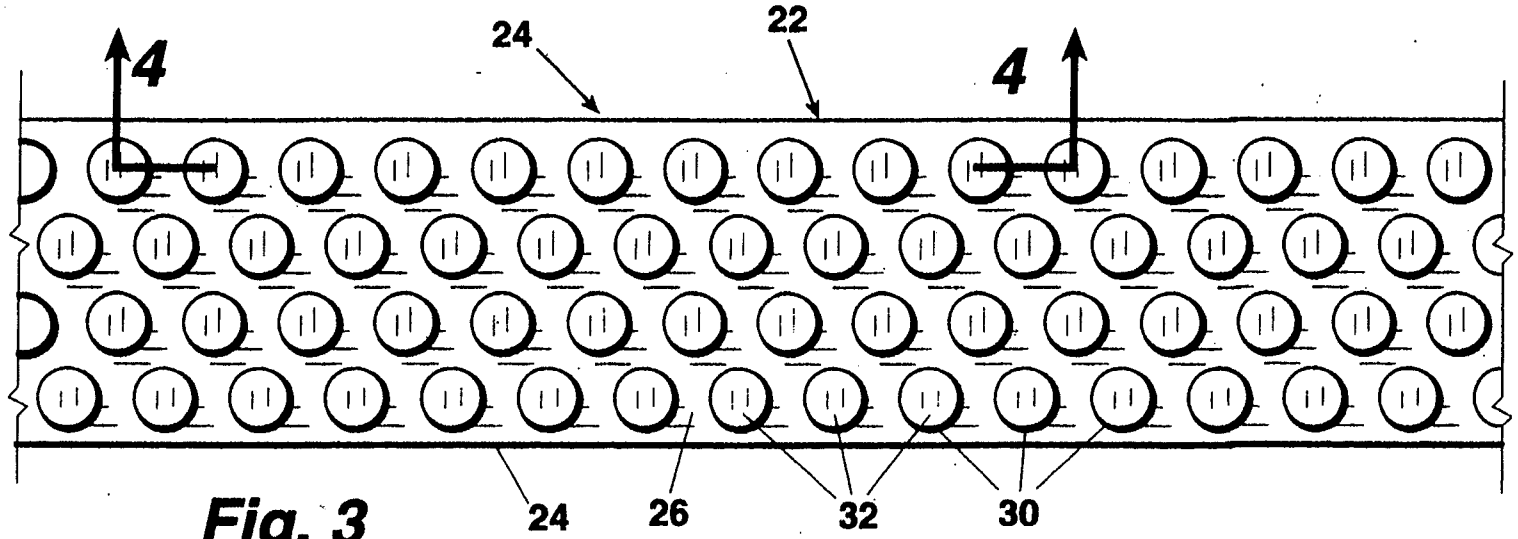
FIG. 3 is a top plan view of an elongated cleaning member made of plastic material such as urethane, the cleaning member having a substratum and integral upstanding studs.
Figure 4:
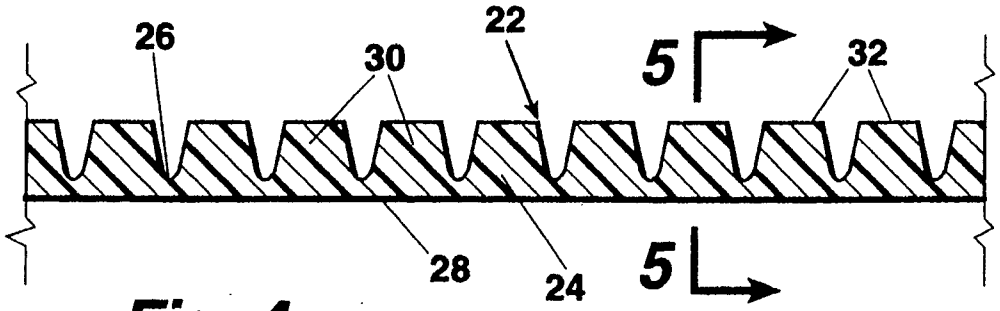
FIG. 4 is a partial cross-sectional view taken along the line 4—4 of FIG. 3 snowing the configuration of the cleaning member and showing the integral upstanding studs.
Figure 5:
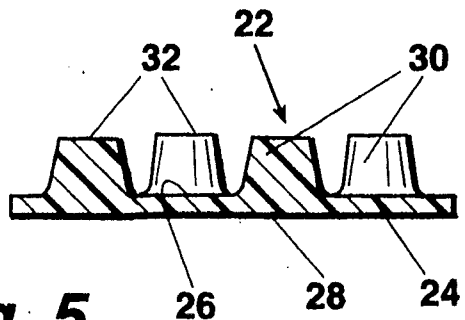
FIG. 5 is a cross-sectional view taken perpendicular to the length of the cleaning member along the line 5—5 of FIG. 4.

FIGS. 3, 4, and 5 show an elongated cleaning member generally indicated by numeral 22. The cleaning member is formed of plastic material, preferably urethane, and includes a substratum portion 24. Substratum 24 has an upper surface 26 and a lower surface 28. The width of elongated cleaning member 22 is substantially equal to or less than the width of a channel 20.

Integrally upwardly extending from the substratum upper surface 26 are a plurality of spaced apart studs 30. The studs may have a variety of cross-sectional configurations, such as square, triangular, rectangular, diamond-shape, etc. The illustrated cross-sectional configuration in FIGS. 3, 4, and 5 show studs 30 with a cylindrical shape or a slightly tapered frustoconical shape. Frustoconical studs 30 have a round cross-section providing round top surfaces 32.

Figure 6:
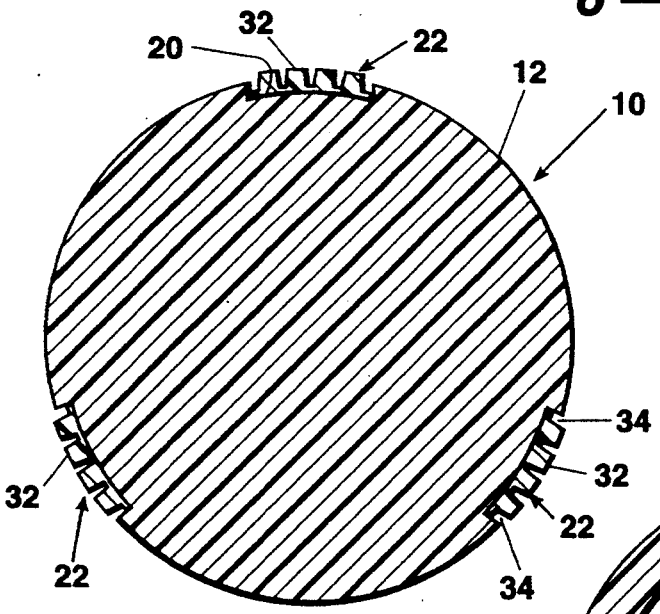
FIG. 6 is a cross-sectional view of the cleaning pig taken along the line 6—6 of FIG. 1 showing cleaning members secured in grooves in the pig body external cylindrical surface.

The height of studs 30 including substratum 24 from which they extend is preferably slightly greater than the depth of channels 20. FIG. 6 is a cross-sectional view showing cleaning members 22 in each of the channels 20 and showing The top surfaces 32 of the studs extending at a height that is slightly above the body external surface 12. Stated another way, top surfaces 32 of the cleaning member studs is at a radius from the cleaning pig longitudinal axis that is greater than the radius of pig body external surface 12.

When a cleaning pig is placed in a pipeline it is moved by the force of fluid or gas flow through the pipeline. A foam pig is preferably dimensioned, as previously stated, such that the diameter of external surface 12 is substantially equal to or slightly greater than the internal diameter of the pipe with which the pig is to be used. In any event, the diameter of top surfaces 32 of the pig should be greater than the internal diameter of the pipe so that the cleaning element top surfaces 32 firmly engage the interior of the pipe as the pig is moved through a pipe. The studs thus serve to contact and clean the interior surface of a pipe. Since the studs are formed of non-metallic material, that is, plastic and preferably urethane, they serve to dislodge rust or corrosion in steel pipes and encrustations or deposits of sediment in plastic pipes. The smooth top surfaces 32 are effective in dislodging encrustations, rust or the like in a way that does not scratch, mar or otherwise damage the interior of a pipeline. This is particularly important when the pig is used for cleaning the interior of a plastic pipeline.

The integral upstanding studs are preferably positioned on substratum 24 so that the outermost studs are placed slightly inwardly of the opposed parallel edges of the substratum. In this manner, when the elongated cleaning member is secured into a channel there remains an unobstructed narrow width passageway 34 between the outermost studs and the channel sidewall, as seen in FIG. 6. This passageway permits a slight amount of liquid or gas that is flowing through the pipeline and that is used to push the pig through the pipeline to flow past the pig to thereby flush debris in front of the pig as it moves through the pipeline. The advantageous of this debris flushing action is set out in U.S. Pat. No. 4,825,498 that has previously been referenced.

The elongated cleaning members 22 can be secured in grooves 20 by the application of a bonding material or adhesive to the cleaning member lower surface 28 so that the elongated cleaning members are securely held in the channels.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A pig for use to clean the interior wall of a pipeline, the pig being configured and dimensioned to be moved through the pipeline by the flow of fluid therethrough, comprising:

an elongated cylindrical body made of plastic foam having an external diameter substantially equal to the internal diameter of the pipeline for which the pig is dimensioned, the pig body having an external cylindrical surface, a forward end and a rearward end;

a plurality of spaced apart shallow depth channels formed in said pig body cylindrical surface, each channel being in a spiral pattern, each channel extending from adjacent said forward end to adjacent said rearward end of said pig body; and an elongated cleaning member positioned in each of said channels, each cleaning member being in the form of a plastic substratum having an upper and a lower surface, and including spaced apart upstanding plastic studs integrally projecting from said substratum upper surface, the studs having top surfaces that extend above said body external cylindrical surface, said substratum lower surface being bonded to said cylindrical body, said upstanding studs each having a top surface to non-abrasively contact and clean the interior surface of a pipeline.

2. A pig for use to clean the interior of a pipe according to claim 1 wherein said cleaning member is made of urethane.

3. A pig for use to clean the interior of a pipe according to claim 1 wherein said pig body is formed of polyurethane foam material.

4. A pig for use to clean the interior of a pipe according to claim 1 wherein there are N said channels in spaced apart spiral format, each channel covering a segment of the cylindrical body external surface through an arc of more than 360°/N whereby as the pig moves through a pipeline the entire internal cylindrical surface of the pipeline is contacted by said upstanding studs of said cleaning member.

5. A pig for use to clean the interior of a pipe according to claim 1 wherein at least some of said integral upstanding studs are each circular in cross-section providing round top stud surfaces.

6. A pig for use to clean the interior of a pipe according to claim 5 wherein said studs are arranged in rows that are in planes perpendicular to the length of said elongated cleaning member and in columns that are in planes each parallel to a plane of the length of said elongated cleaning member.

* * * * *